US006289897B1

(12) United States Patent
McAdam et al.

(10) Patent No.: US 6,289,897 B1
(45) **Date of Patent: *Sep. 18, 2001**

(54) SMOKABLE FILLER MATERIAL FOR SMOKING ARTICLES

(75) Inventors: Kevin Gerard McAdam, Southampton; Rosemary Elizabeth O'Reilly, Eastleigh; Delphine Vernet, Southampton, all of (GB)

(73) Assignee: British-American Tobacco (Investments) Limited, Middlesex (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/142,109

(22) PCT Filed: Mar. 4, 1997

(86) PCT No.: PCT/GB97/00588

§ 371 Date: Nov. 23, 1998

§ 102(e) Date: Nov. 23, 1998

(87) PCT Pub. No.: WO97/32491

PCT Pub. Date: Sep. 12, 1997

(30) Foreign Application Priority Data

Mar. 7, 1996 (GB) ..... 9605116

(51) Int. Cl.[7] ..... A24B 15/00; A24D 1/10

(52) U.S. Cl. ..... 131/359; 131/351; 131/352

(58) Field of Search ..... 131/359, 275, 131/276, 351, 358, 365, 352, 375

(56) References Cited

U.S. PATENT DOCUMENTS

| | | | | |
|---|---|---|---|---|
| 3,931,824 | * | 1/1976 | Miano et al. | 131/359 |
| 4,433,697 | * | 2/1984 | Cline et al. | 131/365 |
| 4,534,372 | * | 8/1985 | White | 131/359 |

FOREIGN PATENT DOCUMENTS

| | | | |
|---|---|---|---|
| 366 835 | * | 5/1990 | (EP) . |
| 1 413 177 | * | 11/1975 | (GB) . |
| 480 003 398 | * | 2/1970 | (JP) . |

* cited by examiner

*Primary Examiner*—James Derrington
*Assistant Examiner*—Dionne A. Walls
(74) *Attorney, Agent, or Firm*—Pitney, Hardin, Kipp & Szuch, LLP

(57) ABSTRACT

A smoking article filler material which comprises a proportion of a non-tobacco, plant material which has an initially high fat or high oil content. The high fat or high oil containing material in combination with a non-combustible inorganic filler, a binder, and an aerosol generating source provides a smokable filler material which may also have a low coal static peak burning temperature.

16 Claims, No Drawings

SMOKABLE FILLER MATERIAL FOR SMOKING ARTICLES

This invention relates to smokable filler material for smoking articles, and in particular to filler material which may not necessarily comprise any tobacco filler material.

In the many efforts which have been made to provide alternative smokable filler materials very few, if any, materials have been found which produce a smoke taste and flavour which is acceptable to smokers of conventional tobacco containing products. Therefore, most alternative filler materials have been used in conjunction with cut tobacco leaf or tobacco-containing reconstituted products. However, even in this form the unacceptable taste of these filler materials is noticeable and detracts from smoking pleasure.

One material which has been used in tobacco-containing compositions is cocoa shells, the shells being a by-product of the chocolate manufacturing process. U.K. Patent Specification 1,180,710 and U.S. Pat. No. 3,429,316 both describe reconstituted tobacco products which incorporate ground cocoa shells, as well as tobacco dust, powder or other tobacco waste from conventional tobacco primary processing techniques. U.S. Pat. No. 4,058,129 also provides a smokable foil material in which grist, comprising small adsorption particles, plant parts, such as threshing refuse or the shells and fibres of coconuts, coffee beans or cocoa beans, and water are mixed together in grinding apparatus to provide a paste which can be made into foils. Tobacco plants can also be used in the process. All of these patents utilise the waste products from cocoa bean shells.

GB 1 413 177 describes a reconstituted tobacco product which consists of a tobacco substitute comprising non-tobacco plant derived material, inorganic filler, binder and plasticiser, as well as tobacco material. The shells, or waste products, of some high fat or high oil containing plants, such as cocoa, coconut and peanut shells, have been used in such a reconstituted tobacco product. Shells of such materials are excluded from the present invention.

JP 48 003398B appears to disclose the addition of amino acid-saccharide compounds and cocoa powder to cut tobacco leaf in order to enhance smoking flavour and taste. This invention concerns modifying a conventional cut tobacco leaf product. Similarly EP 0 366 835 also describes improving the taste and flavour of conventional cut tobacco leaf using an emulsifier containing a fatty acid. This invention relates to adding top flavours and casing materials, a common use for materials such as cocoa in minute amounts.

It is an object of the present invention to provide a smokable filler material with acceptable taste and flavour characteristics for the consumer, which smokable filler material contains little tobacco, and preferably no tobacco, therein.

It is also an object of the invention to provide a smokable filler material which has a lower static peak burning temperature than tobacco, and a narrower and more focused burn zone than tobacco material. We have found that some materials exhibit cool burning temperatures, so much so that the ash of the filler material can be touched almost immediately after smoking, or even during the smoking process, without burning one's finger, or indeed furniture or other combustible materials.

It is a further object of the invention to provide a smokable filler material which has acceptable taste and flavour characteristics and is thus suitable for inclusion with tobacco material, if desired, without detracting from the taste and flavour of the natural tobacco product. The smoking material may alternatively be used as 100% of the smoking article filler material.

A smoking article smokable filler material comprising a proportion of a non-tobacco, plant material, which material is one or more of an at least initially high fat or high oil containing material, the material being the powder or nib of a bean or other fruit of the plant, the seed, flower or nut of the plant, the shell of a plant other than the coffee plant, peanut plant and cocoa plant, or the oil, fat, butter or fatty acid derived from a part of such a high fat or high oil containing material.

The extract or extracts from the plant material may be a suitable fuel material, for example, after spray drying. Likewise, the remainder of the plant material, after extraction has occurred, hereinafter known as residue, may be dried and provide suitable fuel material.

Preferably the smoking article smokable filler material further comprises non-combustible inorganic filler, binder, an aerosol generating source, optionally an expansion medium, optionally carbon, and optionally an organic filler.

Preferably the high fat or high oil containing material is cocoa bean or its powder.

The smoking article smokable filler material may preferably comprise about 5% to about 50% high fat or high oil containing material, extract, residue or derivative therefrom, about 25% to about 80% inorganic filler, about 5% to about 25% binder, about 2% to about 30% aerosol generating source, 0 to about 30% expansion medium, and 0 to about 20% carbon.

Preferably the parent and the residue material can comprise up to 50% by weight of the smokable filler material, and may be more preferably less than 30% and even more preferably less than 25% in respect of the parent material. The oil, butter, fat or fatty acid of the parent material may be added preferably at no more than 20% by weight of the smokable filler material.

Preferably the amount of carbon in the smokable filler material is less than 20% and more preferably less than 10% by weight of the smokable filler material.

Preferably the amount of aerosol generating material is 15% or less by weight of the smokable filler material.

Preferably the amount of binder is less than 15% by weight of the smokable filler material if the binder is not pectin.

Preferably the amount of inorganic filler material is greater than 50% by weight of the smokable filler material, depending on the smoke delivery required.

The expansion medium, if present, may suitably comprise as little as 10% and even 5% by weight of the smokable filler material.

The smokable filler material may suitably comprise 10–20% cocoa powder, 4–6% carbon, 2–20% glycerol, 10% propylene glycol alginate, and 80–44% chalk.

The smokable filler material may also suitably comprise 10–20% cocoa powder, 10–20% glycerol, 10% propylene glycol alginate, 10% sodium alginate, and 50% chalk or perlite.

The smokable filler material may also suitably comprise 30% cocoa powder, 20% glycerol, 10% of one of the binders selected from the group consisting of propylene glycol alginate, sodium alginate, hydroxypropyl cellulose, pectin, sodium carboxymethyl cellulose, sodium calcium alginate and ammonium alginate, and 36% chalk.

The smokable filler material may also suitably comprise 10–30% cocoa powder, 0–10% propylene glycol alginate, 0–25% pectin, 0–10% ammonium alginate, 5–20% glycerol, 25–40% chalk, and 0–11% flavour material.

The smokable filler material may also suitably comprise 20% cocoa powder, 20–30% starch, 10% hydroxypropyl cellulose, 40–50% chalk, as a percentage of the feed rate, and glycerol.

The smokable filler material may also suitably comprise 10–50% cocoa powder, 70–30% chalk, 10% propylene glycol alginate and 0–30% glycerol.

The smokable filler material may also suitably comprise 0–10% carbon, 0–10% cocoa powder, 10% sodium alginate, 10% glycerol, 65–70% chalk and 5–10% oil.

The smokable filler material may also suitably comprise 0–10% extracted cocoa residue, 0–10% cocoa extract, 0–7.7% cocoa butter, 6.3–10% sodium alginate, 6.3–10% glycerol and 43.5–70% chalk.

The percentages given above are by weight of the non-aqueous materials, including glycerol and oil, if present, unless otherwise stated.

The present invention further provides a smoking article smokable filler material comprising non-tobacco fuel material, the fuel material being a high fat or high oil containing material, and an aerosol generating source, the aerosol generating source being a semi-volatile or volatile organic compound, wherein the interaction between the proportion of the fuel material and the aerosol generating source substantially controls the combustibility of the smokable filler material.

Preferably the smokable filler material is a substantially non-tobacco material. As used herein, the term substantially non-tobacco material should be taken to mean containing less than 5% tobacco material by weight of the filler, more preferably less than 3% by weight tobacco material, and even more preferably no tobacco material therein.

Plant materials which would be suitable for the invention include cocoa bean powder, cocoa bean nib, sunflowers, safflower, olives, rape seed, sesame seed, nuts, such as coconut, ground nuts (peanuts), linseed, wheat germ or flax. Other vegetable or plant materials suitable for the invention will be known to the skilled man, for example, others of those plants known as the main oil producing plants of the world, depicted in Table 1 below. These materials may be used alone or in combination. The high fat or high oil plant material may also be known hereafter as the parent material.

TABLE 1

The Main Oil-producing Plants of the World with their Major Fatty Acids

| Common Name | Botanical Name | Family | Major Fatty Acids |
|---|---|---|---|
| Oil palm | *Elaeis guineensis* | Palmae | Fruit: oleic palmitic Kernel: lauric |
| coconut | *Cocos nucifera* | Palmae | lauric |
| corn (maize) | *Zea mays* | Gramineae | linoleic |
| groundnuts | *Arachis hypogaea* | Leguminosae | oleic, linoleic |
| olive | *Olea europaea* | Oleaceae | oleic |
| sunflower | *Helianthus annuus* | Compositae | linoleic |
| soybean | *Glycine max* | Leguminosae | linoleic |
| sesame | *Sesamum indicum* | Pedaliaceae | oleic, linoleic |
| safflower | *Carthamus tinctorius* | Compositae | linoleic |
| cotton | Gossypium sp. | Malvaceae | oleic, linoleic |
| cocoa | *Theobrama cacao* | Sterculiaceae | oleic, stearic |
| shea | *Butyrospermum paradoxum* | Sapotaceae | stearic |
| avocado | *Persea americana* | Lauraceae | palmitic, stearic |
| rapeseed | *Brassica napus* | Cruciferae | crucic (22:1) |
| rapeseed (crucic acid | | | oleic |

TABLE 1-continued

The Main Oil-producing Plants of the World with their Major Fatty Acids

| Common Name | Botanical Name | Family | Major Fatty Acids |
|---|---|---|---|
| free) | | | |
| linseed | *Linum usitatissimum* | Linaceae | linolenic |
| tung | *Aleurites montana* | Euphorbiaceae | eleostearic (18:3) |
| castor oil | *Ricinus communis* | Euphorbiaceae | ricinoleic (12-OH-18:1) |

As used herein the term high fat or high oil material means a parent material comprising at least 10% fat or oil, preferably at least 15% fat or oil, and even more preferably at least 20% fat or oil, by weight of the source material alone. The source material may be any part of the selected plant.

Preferably the high fat or high oil plant material is ground to a powder or otherwise provided as particulate material for use in the filler material. Oil, fat or butter may be used in their natural state, dried or chilled and ground to provide particulate material, or melted to provide a liquid if otherwise solid at room temperature.

The temperature of the coal of some of the present fuel materials has been found to be considerably cooler than the burning temperature of materials, such as carbon, which is typically the fuel material associated with alternative smoking articles. The present fuel material also has a coal static peak burning temperature lower than a similar rod of tobacco material. It appears that the amount of the present fuel material in the fuel mixture also affects the coal static peak burning temperature of the smoking article. Preferably the amount of such fuel material is less than 35% in order to obtain the preferred burning temperature.

We also have evidence to indicate that a reason for the fact that one can touch the coal of a smoking article comprising the present fuel material may be the width of the burning zone. The burn zone width for a cocoa-containing smoking article is considerably narrower than the burn zone width of a similar smoking article containing carbon in similar form.

Preferably, the non-combustible inorganic filler is selected from those materials described in our co-pending PCT application. An organic filler may also substitute for a proportion of the inorganic filler, or be used alone as the filler material. The subject matter of our co-pending PCT Application No. PCT/GB 95/02110 relating to suitable inorganic and organic materials for the present invention is to be considered as incorporated herein by reference thereto. This PCT application will be known herein as our co-pending PCT application. The non-combustible inorganic materials include, such as for example, chalk, perlite, vermiculite, diatomaceous earth, colloidal silica, magnesium oxide, magnesium sulphate or other low density, non-combustible, inorganic filler materials known to those skilled in the art. Organic fillers include inorganic salts of organic acids, polysaccharide material or, for example, organic binder material, present at a level greater than the level required for that material to act purely as a binder.

Suitable binder materials for the present invention include the well known cellulosic or cellulosic derivative binders, alginic or pectinaceous binders, all of which are described in our co-pending PCT application, particularly in relation to the non-combustible wrapper thereof. The binder may be an organic binder, for example, cellulose derivatives, such as sodium carboxymethyl cellulose, methyl cellulose, hydroxypropyl cellulose, hydroxyethyl cellulose or cellulose ethers, alginic binders including soluble alginates such as ammonium alginate, sodium alginate, sodium calcium alginate, calcium ammonium alginate, potassium alginate, magnesium alginate, triethanol-amine alginate and propylene glycol alginate, or insoluble alginates which can be rendered soluble by the addition of solubilising agents, such as ammonium hydroxide. Examples of these include aluminium, copper, zinc and silver alginates. Alginates which are initially soluble but which, during processing, undergo treatment to render them insoluble in the final product may also be used, e.g. sodium alginate going to calcium alginate. Other organic binders include gums such as gum arabic, gum ghatti, gum tragacanth, Karaya, locust bean, acacia, guar, quince seed or xanthan gums, or gels such as agar, agarose, carrageenans, fucoidan and furcellaran. Pectins and pectinaceous materials can also be used as binders. Starches can also be used as organic binders. Other suitable gums can be selected by reference to handbooks, such as Industrial Gums, Ed. Whistler (Academic Press). Inorganic non-combustible binders, such as potassium silicate, magnesium oxide in combination with potassium silicate, or some cements, for example, and mixtures thereof, may also be used, usually in the alternative. Combinations of all of the above may also be used.

The aerosol generating source preferably comprises aerosol forming means, such as glycerol and/or other aerosol forming compounds illustrated in our co-pending PCT application. These include polyhydric alcohols, propylene glycol and triethylene glycol, esters such as triethyl citrate, triacetin or triethylene glycol diacetate (TEGDA), or high boiling point hydrocarbons. Other suitable aerosol forming means will be known to those skilled in the art.

As indicated above, the smokable filler material may suitably be an extruded material, which extruded material may be a foamed or non-foamed material. Suitable expansion mediums or foaming means are described in our co-pending PCT application, the subject matter thereof in relation to expansion mediums being incorporated herein by reference thereto. Suitable expansion mediums include starch, pullulan or other polysaccharides, including cellulose derivatives, solid foaming agents, inorganic salts and organic acids providing in situ gaseous agents, organic gaseous agents, inorganic gaseous agents and volatile liquid foaming agents. Water is most commonly the preferred volatile expansion agent for such expansion systems. Alternative expansion agents are well known. The extruded material may be rods, strands, filaments or sheet material which is then cut to provide filler material. Alternatively the smokable filler material may be cast as a sheet using known conventional band casting or paper making techniques. Entwining or twisting of the strands or filaments may be desirable to provide air passages, if the extruded material does not allow the drawing of air or smoke therealong. Other downstream processing techniques may also be used to improve pressure drop. Various extruded forms are described in our co-pending PCT application and should be taken to be incorporated herein by reference thereto.

The smokable filler material may advantageously also comprise carbon material, activated or not. Preferably the carbon material is powdered or granular carbon material.

Flavourants, casings, such as licorice, or other taste and flavour materials, coffee, tobacco extract or flavourings containing licorice and coffee, for example, may be present in the smokable filler material, as desired. In some cases, the casing material may assist in the combustibility of the smokable filler material, thereby being a fuel material. Plasticisers, such as glycerol, propylene glycol, or other well known plasticisers, may optionally be present at levels at which they do not become the main aerosol component of the smoke.

Smoking article filler material according to the invention may be used with conventional tobacco filler material or other tobacco substitute material as a diluent or a means of lowering the static peak temperature of the cigarette rod.

Smoking article filler material according to the invention is suitable for use in conventional paper wrapped smoking articles, as well as in the alternative smoking article wrapper described in our co-pending PCT application. The subject matter of our PCT application relating to smoking article wrappers is incorporated herein by reference. The smoking article filler material is also suitable for use in the alternative smoking articles described by R. J. Reynolds in their Patent Applications deriving from U.S. Ser. No. 650,604 filed Sep. 14, 1984 and U.S. Ser. No. 684,537 filed Dec. 21, 1984, as either the aerosol generating means or the solid fuel element in those devices known as 'Premier'-type devices. The present material may partially or fully replace the material described in those U.S. specifications, and others deriving therefrom. The filler material of the present invention may thus also be known as a fuel source material.

The smokable filler material may contain the high fat or high oil material in an amount in the filler material, which amount may not provide a smokable filler material with an overall high fat or high oil content. Thus, the initial high fat or high oil material may, for example, have the flavour and/or fat or oil components extracted therefrom and the treated remainder, or parent material, may be used as a substrate material to which only a proportion of the fat or oil is re-added. The treated remainder is itself available as a combustible fuel material, with or without the extracted portion being added thereto. In the alternative, the extracted flavour, fat or oil components or other extracts from other high fat or high oil sources, for example, cocoa, may serve as the fuel material after spray drying, for example, or be added to another substrate. The substrate may be organic or inorganic. Preferably the inorganic substrate is substantially non-combustible. Organic or inorganic materials such as those described in our co-pending PCT Application No. PCT/GB 95/02110 and outlined above may be the substrate materials to which the, or a proportion of the, extracted components may be added.

The invention also provides a smoking article comprising a wrapper enwrapping a rod of smokable filler material in accordance with any one of those described above.

Advantageously the wrapper is a substantially non-combustible wrapper such as that described in our co-pending PCT application. The subject matter thereof relating to the substantially non-combustible wrapper is to be considered as incorporated herein by reference thereto. In summary, the wrapper comprises predominantly non-combustible, particulate, inorganic filler material, a binder and/or a plasticiser, and optionally a small amount of fibre. These materials have all been described above.

Preferably, the substantially non-combustible wrapper is comprised of predominantly non-combustible inorganic filler material. The term 'predominantly' as used herein means at least about 65% and usually 70%. The inorganic filler material advantageously yields very little or substantially no visible sidestream smoke when the smoking article is lit. Preferably the non-combustible wrapper comprises at least 80%, and more preferably at least 90% inorganic filler material by weight of the wrapper.

The non-combustible wrapper may comprise a small amount of cellulosic fibre material. Preferably the fibre material comprises less than 10%, more preferably less than 5%, and even more preferably less than 2% by weight of the non-combustible wrapper. Most advantageously the fibre material is not present in the wrapper.

Preferably, the wrapper comprises a binder and/or a plasticiser. These components may be present at up to 30% by weight of the wrapper. Advantageously the binder is not present at more than 25% by weight of the wrapper. The exact proportions will depend on the taste characteristics, acceptable visible sidestream smoke emission and strength of the desired product, and the processing techniques used. The binder may be present at about 8–10% by weight of the wrapper, although it may be present at about 5% or less by weight of the wrapper.

The wrapper, although not giving much, if any, visible sidestream smoke, does produce ash of an acceptable colour and quality. The smoking article also has a visible burn line which advances along the article and enables the smoker to determine whether the article is alight and to monitor the smoking process. The visible burn line may be formed as a result of heating the organic binder to temperatures at which the binder will thermally degrade to produce a brown/black char colouration. Alternatively, colour changing compounds can be included in the wrapper composition. Colourants which give the wrapper an other than white colour may also be included. These colourants may also change colour as heating occurs, providing a visible burn line, e.g. $CuSO_4.5H_2O$.

The nature of the binder selected will also determine the permeability of the outer wrapper. Binders, such as sodium carboxymethyl cellulose and propylene glycol alginate, have been found to be particularly effective at producing an outer wrapper sufficiently permeable to sustain combustion of the fuel source within the wrapper. The latter binder gave the more permeable outer for the same outer wrapper composition. Hydration time of some binders can play a part in determining the efficacy of the binders. Conventionally understood strong binders such as hydroxypropyl cellulose can be used at lower levels to increase the wrapper permeability but this has to be balanced against the strength of the wrapper.

The plasticiser may be present in the wrapper at up to 20% by weight thereof. The plasticiser is preferably present at about 10% or less, preferably 5% or less, by weight of the wrapper. The plasticiser may be glycerol, propylene glycol, or low melting point fats or oils for example. Depending on the method of production selected for the wrappers, the plasticiser may be absent from the wrapper composition. The plasticiser helps in the drying stages of the wrapper to prevent shape distortion, particularly if direct heat, e.g. hot air, is the drying medium. Other methods of preparing the wrapper are outlined in our co-pending PCT application. These methods are incorporated herein by reference thereto. The amount of plasticiser, binder or other organic filler material will affect the appearance of the burn line, i.e. the burn line width, and the amount of visible sidestream of the article. Preferably the width of the burn line is not greater than 10 mm, is preferably not more than 5 mm and more preferably is between 2–3 mm in width. The width of the burn line depends on the composition of the burnable material in the article.

In order that the invention may be easily understood and readily carried into effect the following examples were performed to illustrate the invention and aspects thereof.

EXAMPLE 1

Filler materials were produced by preparing various mixtures comprised of various proportions of cocoa powder, carbon, glycerol, propylene glycol alginate (PGA) as the binder, and chalk as the inorganic filler material. Full details of the compositions are given in Table 2 below. The mixture, when hydrated, was inserted into a syringe having a circular nozzle of 1 mm diameter and strands of the filler material were extruded onto plastic sheets. The strands were left to dry in air at room temperature overnight.

Single strands of the filler material were ignited with a lighter to see if the composition was combustible. It can be seen that, for a cocoa and binder composition of about 10% each by weight of the dry mixture, at least about 3% of glycerol is required to sustain combustion. It can also be seen that the filler material will not combust at the levels exemplified without any cocoa powder.

Table 2 also gives an indication that there may be a relationship between the proportion of cocoa powder and glycerol in the filler material which are required to produce a burnable filler material. This relationship is investigated more in Table 3 of Example 2.

EXAMPLE 2

A number of filler material compositions were produced as outlined in Table 3 below. Samples 20–22 were dried by various methods; drying in air at room temperature overnight, drying in an oven at 70° C. overnight, drying by extruding into an ethanol bath of standard laboratory grade ethanol to remove water molecules by scavenging, or extruding into a bath containing a 1M calcium chloride (aqueous) solution for 10 seconds, removing the extrudate, then allowing it to air dry. None of these samples burned at the compositions selected. In contrast, when chalk is substituted for perlite as the inorganic filler in samples 23–25, the mixture is more combustible. Of the three drying methods tested for these samples, only drying using the calcium chloride method prevents combustion. Air dried and ethanol dried samples 25 and 23 respectively both combust. Clearly, some inorganic fillers at the compositions selected are more preferable than others.

In the table NaALG means sodium alginate.

EXAMPLE 3

Various compositions of filler material were produced as detailed in Table 4. In order to determine the effect of the binder on the acceptability of the smoke flavour, various binders were tried. in an otherwise constant dry mixture. A flavouring agent was also incorporated in all samples at a level of 4% by weight of the dry mixture.

In the table HPC means hydroxypropyl cellulose and SCMC means sodium carboxymethyl cellulose.

As can be seen from Table 4, all of the compositions were combustible. The flavour rating indicates the preferred binder. A rating of 1 is the most preferred smoke taste. A rating of 7 is the least preferred smoke taste.

EXAMPLE 4

In order to assess the smoke deliveries of smoking articles containing smokable filler according to the present invention, strands of filler material were inserted into a substantially non-combustible, pre-extruded wrapper. Sufficient strands of filler material were used to provide a well-packed smoking article. In practice, 15–20 strands of 1 mm diameter can be inserted into a wrapper having an internal diameter of about 7.0 mm. The compositions of the strands are indicated in Table 5 below. Four different flavour compositions were used in the strands, as indicated. Flavours 2 and 4 were coffee and licorice respectively. Flavours 1 and 3 included proportions of both coffee and licorice.

The substantially non-combustible wrapper was made from 10 g sodium alginate (Kelvis grade—supplied by Kelco International) hydrated in 200 ml water while being shred in a Crypto Fearless food mixer for 1 hour, 90 g perlite (PO5 grade), which was previously ground to a particle size of ≦120 μm is added to the binder/water mixture with constant stirring for a further hour. The paste was extruded through a torpedo die of a ram extruder to give a tube in excess of 69 mm length and 0.5 mm wall thickness. The tube was extruded into a 1 liter of 1M calcium chloride (aqueous) solution, then removed after 10 seconds, allowed to dry in air overnight at room temperature, cut to length and a filter attached. Strands of extruded filler material were inserted into the wrapper. About 18 strands could be inserted.

Table 5 below shows the compositions of the fuel source, i.e. filler material, and the smoke data generated from cigarettes made from the so-filled wrappers when attached to a filter element of fibrous cellulose acetate tow of 27 mm length having a pressure drop of about 70 mm WG. The smoking articles were smoked under standard machine smoking conditions of a 35 $cm^3$ puff of 2 seconds duration every minute to a butt length, including filter, of 35 mm length.

The results show that the smoking articles produce a large amount of smoke and that there is a high water and glycerol content to the smoke.

EXAMPLE 5

Table 6 shows the composition, manufacturing conditions and smoke yields from foamed extruded cocoa powder containing fuel rods. Pre-gelatinised maize starch was used as a polysaccharide expansion medium with hydroxypropyl cellulose as the binder, chalk as the inorganic filler and glycerol as the plasticiser. The powder materials were dry blended and fed to a BC21 Clextral extruder. Water was fed to the extruder barrel at a feed rate in liters per hour, as was glycerol (in a 50:50 aqueous solution).

In the Tables the total solids (in grams) is the weight of the dry mix, including glycerol.

Downstream of the extruder die was conveying means comprising an air knife (or knives) and a co-operating pair of endless grooved belts. The grooved belts were operable to draw the extrudate away from the extruder die at any chosen speed. Thus, haul off is achieved via this method, allowing elongation of the products. 64 mm lengths of material are cut by a rotary cutter. Some drying of the product may be achieved in the downstream process before cutting into rod lengths by means of an air blower, located downstream of the air knife and upstream of the conveying means.

In order to provide acceptable rod pressure drop, some rod samples required a further downstream handling process to produce a more acceptable pressure drop.

The 64 mm foamed cocoa rod lengths were then smoked without a wrapper of any sort under standard machine smoking conditions without a filter element attached thereto.

EXAMPLE 6

Measurements of the static peak temperature of the burning coal of a number of smoking articles were made by the standard technique using Infra-red thermography. Ribbons of the non-foamed mixtures described in Table 7 were extruded at room temperature and pressure through a 1 cm wide, ½ mm thick ribbon die of a ram extruder. These ribbons were ignited and allowed to smoulder in static air. The percentages given in Table 7 are by total weight of the ingredients of the smokable filler material. The binder is propylene glycol alginate.

Table 7 shows that glycerol appears to have little influence on the burn temperature of either cocoa- or carbon-based filler materials. In contrast, increasing the amount of cocoa in the smokable filler material appears to increase the burn temperature of the filler material, apparently towards a limiting value. A relatively minor increase in burn temperature is also seen in the increasing carbon in the filler material. In both charts the cocoa-based smokable filler materials exhibit a considerably lower average burn temperature than is exhibited by carbon. Carbon is, of course, readily associated as the fuel material in many alternative smoking articles.

Our studies have also shown that there is a relatively localised burn area for cocoa-based smokable filler materials, compared with a wider burn zone for carbon-based filler materials. Cocoa, therefore, exhibits advantages over the well-known carbon fuel source of other alternative smoking articles.

In Examples 7 and 8 below fuel materials were prepared by mixing the solid particulate ingredients in a food blender. The liquid components were added while the solid components were being rapidly stirred, in order to ensure thorough mixing. After all the water had been added the mixture was stirred for 30 minutes to allow the binder sufficient time for complete hydration. The resulting slurry was cast onto a heated stainless steel rotating drum which was maintained at a temperature of 105° C. The slurry was introduced onto the drum through a slit of 0.75 mm width. The dried sheet material was collected from the drum in sheet form conditioned at 60% relative humidity overnight and shredded through an office shredder. The resulting strands were similar in size to tobacco strands.

EXAMPLE 7

Table 8 shows the effect of either adding oil to a fuel material as an additional fuel or using oil as the fuel material added to a substantially inorganic substrate. The samples were then assembled into paper-wrapped cigarettes 84 mm long, with a 27 mm cellulose acetate filter and 32 mm tipping. The cigarettes were smoked under standard ISO machine smoking conditions in which a 35 $cm^3$ puff of 2 seconds duration is taken every minute to a 35 mm butt length. Smoke deliveries were obtained gravimetrically using a Cambridge filter pad.

The fuel materials offer a further control mechanism for smoke deliveries, particularly in terms of their diluent effect.

EXAMPLE 8

In the manner described above fuel material which comprised an extracted residue of a parent material, namely cocoa powder and/or a proportion of cocoa butter, or the extract itself alone, were produced and smoked. The formulations and results are given in Table 9. Sample 6 contained a residue after acidified water extraction, Sample 7 contained the residue after alcohol extraction and Sample 8 contained the residue after aqueous 1M sodium hydroxide extraction. Sample 9 was the extract from the cocoa powder itself after extraction with aqueous 1M citric acid.

It can be seen that the parent material will act as a fuel source, as will the extract itself. They also provide a mechanism of controlling smoke delivery in terms of their effect on the smoking characteristics of smoking articles containing such filler material.

The fuel material of the present invention exhibits good taste and flavour characteristics, lower static peak burning temperatures, lower sidestream smoke and a more localised burn zone. All of these features are improvements over prior proposed tobacco substitute materials or alternative smokable filler materials. The low sidestream smoke characteristics can be enhanced by careful selection of the cigarette wrapper utilised in the smoking article.

TABLE 2

Combustion Propensity of Cocoa/Glycerol Fuel Mixtures - Influence of Cocoa and Glycerol Incorporation

| | Sample Number | | | | | | | | | | | | | | | |
|---|---|---|---|---|---|---|---|---|---|---|---|---|---|---|---|---|
| Component | 1 | 2 | 3 | 4 | 5 | 6 | 7 | 8 | 9 | 10 | 11 | 12 | 13 | 14 | 15 | 16 |
| Water (ml) | 40 | 40 | 40 | 40 | 40 | 40 | 40 | 40 | 40 | 40 | 40 | 40 | 40 | 40 | 40 | 40 |
| Total Solids (g) | 20 | 20 | 20 | 20 | 20 | 20 | 20 | 20 | 20 | 20 | 20 | 20 | 20 | 20 | 20 | 20 |
| Cocoa (%) | 10 | 10 | 10 | 10 | 10 | 10 | 10 | 10 | 20 | 20 | 20 | 20 | 0 | 0 | 20 | 20 |
| Carbon (%) | 0 | 0 | 0 | 0 | 0 | 0 | 0 | 0 | 0 | 0 | 0 | 0 | 0 | 0 | 4 | 6 |
| Glycerol (%) | 0 | 2 | 4 | 8 | 10 | 13 | 18 | 20 | 5 | 8 | 15 | 20 | 20 | 15 | 20 | 20 |
| PGA (%) | 10 | 10 | 10 | 10 | 10 | 10 | 10 | 10 | 10 | 10 | 10 | 10 | 10 | 10 | 10 | 10 |
| Chalk (%) | 80 | 78 | 76 | 72 | 70 | 67 | 62 | 60 | 65 | 62 | 55 | 50 | 70 | 75 | 46 | 44 |
| Air dried | Y | Y | Y | Y | Y | Y | Y | Y | Y | Y | Y | Y | Y | Y | Y | Y |
| Burns? | N | N | Y | Y | Y | Y | Y | Y | Y | Y | Y | Y | N | N | Y | Y |

TABLE 3

Combustion Propensity of Cocoa/Binder Fuel Mixtures - Influence of Filler

| | Sample Number | | | | | |
|---|---|---|---|---|---|---|
| Component | 20 | 21 | 22 | 23 | 24 | 25 |
| Water (ml) | 145 | 145 | 110 | 110 | 110 | 110 |
| Total Solids (g) | 50 | 50 | 50 | 50 | 50 | 50 |
| Cocoa (%) | 10 | 20 | 20 | 20 | 20 | 20 |
| Glycerol (%) | 10 | 20 | 20 | 20 | 20 | 20 |
| PGA (%) | 0 | 0 | 10 | 10 | 10 | 10 |
| Na ALG (%) | 10 | 10 | 0 | 0 | 0 | 0 |
| Chalk (%) | 0 | 0 | 0 | 50 | 50 | 50 |
| Perlite (%) | 70 | 50 | 50 | 0 | 0 | 0 |
| Burns? | N | N | N | Y | N | Y |

TABLE 4

Influence of binder on perceived acceptability of smoke flavour from smoking articles

| | Sample Number | | | | | | |
|---|---|---|---|---|---|---|---|
| Component | 30 | 31 | 32 | 33 | 34 | 35 | 36 |
| Water (ml) | 60 | 60 | 60 | 60 | 80 | 100 | 70 |
| Total Solids (g) | 50 | 50 | 50 | 50 | 50 | 50 | 50 |
| Cocoa (%) | 30 | 30 | 30 | 30 | 30 | 30 | 30 |
| Glycerol (%) | 20 | 20 | 20 | 20 | 20 | 20 | 20 |
| PGA (%) | 0 | 0 | 0 | 10 | 0 | 0 | 0 |
| Na ALG (%) | 0 | 10 | 0 | 0 | 0 | 0 | 0 |
| HPC (%) | 0 | 0 | 0 | 0 | 10 | 0 | 0 |
| Pectin (%) | 0 | 0 | 10 | 0 | 0 | 0 | 0 |
| SCMC (%) | 0 | 0 | 0 | 0 | 0 | 10 | 0 |
| Sodium Calcium Alginate (%) | 0 | 0 | 0 | 0 | 0 | 0 | 10 |
| Ammonium Alginate (%) | 10 | 0 | 0 | 0 | 0 | 0 | 0 |
| Chalk (%) | 36 | 36 | 36 | 36 | 36 | 36 | 36 |
| Burns? | Y | Y | Y | Y | Y | Y | Y |
| Flavour Rating | 1 | 2 | 3 | 4 | 5 | 6 | 7 |

TABLE 5

Smoke Deliveries from Smoking Articles based on Cocoa Fuels

| | Sample Number | | | | | | | | |
|---|---|---|---|---|---|---|---|---|---|
| Composition | 40 | 41 | 42 | 43 | 44 | 45 | 46 | 47 | 48 |
| Cocoa (%) | 30 | 30 | 30 | 30 | 30 | 30 | 30 | 30 | 30 |
| PGA (%) | 10 | 10 | 10 | 0 | 0 | 0 | 0 | 0 | 0 |
| Pectin (%) | 0 | 0 | 0 | 25 | 25 | 25 | 0 | 0 | 0 |
| Ammonium Alginate (%) | 0 | 0 | 0 | 0 | 0 | 0 | 10 | 10 | 10 |
| Glycerol (%) | 20 | 20 | 20 | 20 | 20 | 20 | 20 | 20 | 20 |
| Chalk (%) | 40 | 40 | 46 | 25 | 25 | 25 | 40 | 40 | 40 |
| Flavour 1 (%) | 0 | 0 | 0 | 0 | 0 | 0 | 0 | 0 | 0 |
| Flavour 2 (%) | 0 | 0 | 0 | 0 | 0 | 0 | 0 | 0 | 0 |
| Flavour 3 (%) | 0 | 0 | 0 | 0 | 0 | 0 | 0 | 0 | 0 |
| Flavour 4 (%) | 0 | 0 | 0 | d | 0 | 0 | 0 | 0 | 0 |
| Smoke Data | | | | | | | | | |
| Puff Number | 11.0 | 11.50 | 11.25 | 15.0 | 14.6 | 12.1 | 15.0 | 11.0 | 15.3 |
| TPM (mg/cig) | 35.0 | 28.1 | 25.7 | 35.7 | 34.5 | 26.4 | 44.6 | 24.9 | 29.2 |
| Water (mg/cig) | n/m | 6.9 | n/m | n/m | 8.5 | n/m | n/m | 5.6 | n/m |
| Glycerol (mg/cig) | 13 | n/in | n/m | 13 | n/m | n/m | 16 | n/m | n/m |

n/m = not measured
n/d = not detected

TABLE 5a

Smoke Deliveries from Smoking Articles based on Cocoa Fuels

| Composition | 49 | 50 | 51 | 52 | 53 | 54 | 55 | 56 |
|---|---|---|---|---|---|---|---|---|
| Cocoa (%) | 30 | 30 | 30 | 30 | 30 | 30 | 20 | 10 |
| PGA (%) | 0 | 0 | 0 | 0 | 0 | 0 | 10 | 10 |
| Pectin (%) | 25 | 25 | 25 | 0 | 0 | 0 | 0 | 0 |
| Ammonium Alginate (%) | 0 | 0 | 0 | 10 | 10 | 10 | 0 | 0 |
| Glycerol (%) | 5 | 5 | 5 | 20 | 20 | 20 | 20 | 13 |
| Chalk (%) | 29 | 29 | 29 | 29 | 29 | 29 | 50 | 67 |
| Flavour 1 (%) | 1 | 1 | 1 | 0 | 0 | 0 | 0 | 0 |
| Flavour 2 (%) | 5 | 5 | 5 | 5 | 5 | 5 | 0 | 0 |
| Flavour 3 (%) | 0 | 0 | 0 | 1 | 1 | 1 | 0 | 0 |
| Flavour 4 (%) | 5 | 5 | 5 | 5 | 5 | 5 | 0 | 0 |
| Smoke Data | | | | | | | | |
| Puff Number | 15.0 | 12.3 | 15.4 | 15.0 | 17.4 | 17.3 | 8.0 | n/m |
| TPM (mg/cig) | 28.2 | 27.1 | 32.2 | 34.1 | 39.8 | 27.4 | 11.2 | 4.5 |
| Water (mg/cig) | n/m | 13.7 | n/m | n/m | 8.4 | n/m | n/m | n/m |
| Glycerol (mg/cig) | n/d | n/m | n/m | 12 | n/m | n/m | 5 | n/m |

n/m = not measured
n/d = not detected

TABLE 6

Combustion, Manufacturing Conditions and Smoke Yields from Extruded Cocoa Fuel Rods

| | Sample Number | | | | | | | | | |
|---|---|---|---|---|---|---|---|---|---|---|
| | 60 | 61 | 62 | 63 | 64 | 65 | 66 | 67 | 68 | 69 |
| Composition* | | | | | | | | | | |
| Cocoa (%) | 20 | 20 | 20 | 20 | 20 | 20 | 20 | 20 | 20 | 20 |
| Starch (%) | 20 | 20 | 20 | 20 | 30 | 30 | 30 | 30 | 30 | 30 |
| HPC (%) | 10 | 10 | 10 | 10 | 10 | 10 | 10 | 10 | 10 | 10 |
| Chalk (%) | 50 | 50 | 50 | 40 | 40 | 40 | 40 | 40 | 40 | 40 |
| Glycerol (l/hr) | 0.51 | 0.51 | 0.51 | 0.51 | 0.51 | 0.51 | 0.51 | 0.51 | 0.51 | 0.51 |
| Water (l/hr) | 0.32 | 0.32 | 0.32 | 0.32 | 0.32 | 0.32 | 0.32 | 0.32 | 0.32 | 0.32 |
| Conditions | | | | | | | | | | |
| Temperature zone 1 ° C. | 70 | 70 | 70 | 70 | 70 | 70 | 70 | 70 | 70 | 70 |
| Temperature zone 2 ° C. | 110 | 110 | 110 | 110 | 110 | 110 | 110 | 120 | 120 | 120 |
| Temperature zone 3 ° C. | 115 | 115 | 115 | 115 | 115 | 115 | 115 | 125 | 125 | 125 |
| Temperature zone 4 ° C. | 115 | 115 | 115 | 115 | 115 | 115 | 115 | 125 | 125 | 125 |
| Temperature zone 5 ° C. | 115 | 115 | 115 | 115 | 115 | 115 | 115 | 125 | 125 | 125 |
| Screw speed (rpm) | 275 | 275 | 275 | 225 | 225 | 225 | 225 | 226 | 226 | 226 |
| Feed rate (kg/hr) | 4.84 | 4.84 | 4.84 | 4.84 | 4.84 | 4.84 | 4.84 | 4.84 | 4.84 | 4.84 |
| Pressure (bar) | 9 | 9 | 9 | 16–17 | 16–17 | 16–17 | 16–17 | 13 | 13 | 13 |
| Rod dimensions | | | | | | | | | | |
| Length (mm) | 65 | 65 | 65 | 65 | 65 | 65 | 65 | 65 | 65 | 65 |
| Weight (g) | 0.552 | 0.557 | 0.557 | 0.581 | 0.595 | 0.584 | 0.652 | 0.774 | 0.629 | 0.634 |
| Pressure Drop (mm WG) | 58 | 124 | 350 | 56 | 91 | 374 | >1000 | >1000 | 672 | 269 |
| Circumference (mm) | 23.86 | 24.22 | 24.53 | 23.2 | 23.57 | 23.87 | 25.34 | 24.92 | 23.96 | 23.76 |
| Smoke Deliveries | | | | | | | | | | |
| Puff Number | 2.8 | 3.44 | 3.0 | 3.0 | 3.2 | 4.0 | 5.0 | 6.0 | 4.56 | 3.9 |
| Length burnt (mm) | 33 | 33 | 33 | 33 | 33 | 33 | 33 | 33 | 33 | 33 |
| Butt length (mm) | 32 | 32 | 32 | 32 | 32 | 32 | 32 | 32 | 32 | 32 |
| TPM Delivery (mg/cig) | 4.48 | 6.22 | 2.98 | 5.4 | 6.36 | 3.33 | 0.56 | 0.0 | 0.58 | 4.22 |

*% given as % of feed rate

TABLE 7

Effect of Fuel Composition on Burn Temperature

| % Fuel Material | | % | % | % | Burn |
|---|---|---|---|---|---|
| Carbon | Cocoa | Chalk | Binder | Glycerol | Temperature ° C. |
| 20 | — | 70 | 10 | 0 | 840 |
| 20 | — | 60 | 10 | 10 | 866 |
| 20 | — | 50 | 10 | 20 | 874 |
| 20 | — | 40 | 10 | 30 | 877 |
| — | 20 | 70 | 10 | 0 | 725 |
| — | 20 | 60 | 10 | 10 | 658 |
| — | 20 | 50 | 10 | 20 | 721 |
| — | 20 | 40 | 10 | 30 | 679 |
| 10 | — | 70 | 10 | 10 | 812 |
| 20 | — | 60 | 10 | 10 | 866 |
| 35 | — | 45 | 10 | 10 | 870 |
| 50 | — | 30 | 10 | 10 | 877 |
| — | 10 | 70 | 10 | 10 | 671 |
| — | 20 | 60 | 10 | 10 | 658 |
| — | 35 | 45 | 10 | 10 | 812 |
| — | 50 | 30 | 10 | 10 | 816 |

TABLE 8

| | Sample No. | | | | |
|---|---|---|---|---|---|
| Material (g) | 1 | 2 | 3 | 4 | 5 |
| Carbon | 10 | 10 | — | — | — |
| Cocoa | — | — | 10 | 10 | — |
| Sodium alginate | 10 | 10 | 10 | 10 | 10 |
| Glycerol | 10 | 10 | 10 | 10 | 10 |
| Chalk | 65 | 65 | 65 | 65 | 70 |
| Water (ml) | 420 | 425 | 385 | 445 | 420 |
| Oil type | wheat germ | sunflower | soybean | olive | sunflower |
| Oil amount | 5 | 5 | 5 | 5 | 10 |
| Smoke Data | | | | | |
| Fuel weight (g) m | 1.01 | 0.89 | 1.04 | 0.95 | 0.84 |
| Cigarette Puff Number | 7 | 6 | 7 | 6 | 4 |
| Smoke Delivery (wet tar) (mg) | 16.4 | 13.7 | 16.9 | 16.9 | 15.9 |

TABLE 9

| | Sample No. | | | |
|---|---|---|---|---|
| Material (g) | 6 | 7 | 8 | 9 |
| Extracted Cocoa residue | 10 | 6.3 | 7.7 | — |
| Cocoa extract | — | — | — | 10 |
| Cocoa butter | — | 0.63 | 7.7 | — |
| Sodium alginate | 10 | 6.3 | 7.7 | 10 |
| Glycerol | 10 | 6.3 | 7.7 | 10 |
| Water (ml) | 445 | 280 | 380 | 450 |
| Chalk | 70 | 43.5 | 46.2 | 70 |
| Smoke Data | | | | |
| Fuel weight in cigarette (g) | 1.19 | 1.22 | 0.98 | 0.88 |
| Puff Number | 6 | 8 | 7 | 10 |
| Smoke Delivery (wet tar) (mg) | 8.6 | 12.0 | 16.3 | 6.7 |

What is claimed is:

1. A smokable filler material comprising a fuel material consisting of a non-tobacco, plant material, which material is one or more of an at least initially high fat or high oil containing material selected from the group consisting of the powder or nib of a bean or other fruit of the plant; the seed, flower or nut of the plant, or the oil, fat, butter or fatty acid derived from a part of such a high fat or high oil containing material, wherein said filler material comprises about 5% to about 50% high fat or high oil containing material, or an extract, residue or derivative therefrom, about 25% to about 80% non-combustible inorganic filler, about 5% to about 25% binder, about 2% to about 30% aerosol generating source, 0 to about 30% expansion medium, 0 to about 10% carbon, and 0 to about 5% tobacco.

2. A smoking article smokable filler material according to claim 1, wherein the smoking article filler material further comprises an organic filler.

3. A smokable filler material according to claim 2, wherein said organic filler is an organic salt of an organic acid or polysaccharide material.

4. A smokable filler material according to claim 1, wherein the high fat or high oil containing material is cocoa bean or nib powder.

5. A smokable filler material according to claim 1, wherein the high fat or high oil containing material is, or is derived from, one or more of oil palm, coconut, corn (maize), groundnut, olive, sunflower, soybean, sesame, safflower, cotton, shea, avocado, rapeseed, linseed, tung, castor oil, wheat germ or flax.

6. A smokable filler material according to claim 1, wherein the fuel material is less than 35% by weight of the dry materials.

7. A smokable filler material according to claim 1, wherein said binder is either an organic binder selected from the group comprising a cellulosic or cellulosic derivative binder, an alginic or pectinaceous binder, a gum or a gel, or an inorganic non-combustible binder, such as potassium silicate, magnesium oxide in combination with potassium silicate or some cements, and mixtures thereof.

8. A smokable filler material according to claim 1, wherein the aerosol generating source comprises aerosol forming means selected from the group consisting of polyhydric alcohols, propylene glycol, triethylene glycol, glycerol, esters or high boiling point hydrocarbons.

9. A smokable filler material according to claim 1, wherein said suitable expansion medium is selected from the group consisting of starch, pullulan or other polysaccharides, including cellulose derivatives, solid foaming agents, inorganic salts and organic acids which provide in situ gaseous agents, organic gaseous agents, inorganic gaseous agents and volatile liquid foaming agents.

10. A smoking article comprising smokable filler according claim 1, wherein said filler material is wrapped in a paper wrapper or in a substantially non-combustible wrapper comprising predominantly non-combustible, inorganic filler material, a binder and/or a plasticiser, and optionally a small amount of fibre.

11. A smoking article according to claim 10, wherein said non-combustible inorganic filler is particulate.

12. A smokable filler material according to claim 1, wherein oil, fat, butter or fatty acid derived from said high fat or high oil containing material is added to untreated high fat or high oil containing material, the extracted residue thereof or another substrate material.

13. A smokable filler material according to claim 12, wherein the substrate material comprises tobacco material.

14. A smokable filler according to claim 1, wherein the non-combustible inorganic filler is selected from the group consisting of chalk, perlite, vermiculite, diatomaceous earth, colloidal silica, magnesium oxide, magnesium sulphate or other low density, non-combustible inorganic filler materials.

15. A smokable filler material according to claim 1, wherein the initial high fat or high oil containing material is subjected to extraction to provide an extracted material and only a portion of said extracted material is re-combined with the residue thereof.

16. A smoking article filler material comprising non-tobacco fuel material, the fuel material being a high fat or high oil containing material, comprising at least 10% by weight fat or at least 10% by weight oil, selected from the group consisting of cocoa bean or nib powder, oil palm, coconut, corn (maize) excluding shells or husks, groundnut, olive, sunflower, soybean, sesame, safflower, cotton, shea, avocado, rapeseed, linseed, tung, castor oil, wheat germ or flax, or the oil, fat, butter or fatty acid derived from said high fat or high oil containing material, or an extract or extracted residue thereof, and an aerosol generating source, the aerosol generating source being a semi-volatile or volatile organic compound, wherein the interaction between the proportion of the fuel material and the aerosol generating source substantially controls the combustibility of the smokable filler material.

* * * * *